US005349982A

United States Patent [19]

Goldsmith

[11] Patent Number: 5,349,982

[45] Date of Patent: Sep. 27, 1994

[54] CONTROL MECHANISM FOR WATER BLASTING GUN

[75] Inventor: Peter J. Goldsmith, Houston, Tex.

[73] Assignee: Control Rain Systems, Inc., Houston, Tex.

[21] Appl. No.: 136,121

[22] Filed: Oct. 13, 1993

[51] Int. Cl.[5] ..... B05B 1/14

[52] U.S. Cl. ..... 137/454.5; 137/882; 239/124; 251/124

[58] Field of Search ..... 137/454.5, 882; 251/321, 322; 239/124

[56] References Cited

U.S. PATENT DOCUMENTS

| | | | |
|---|---|---|---|
| 3,765,607 | 10/1973 | Pacht | 239/124 |
| 3,986,523 | 10/1976 | Pacht | 137/882 |
| 4,602,740 | 7/1986 | Stachowiak | 137/882 X |
| 5,165,451 | 11/1992 | Goldsmith | 239/124 X |

*Primary Examiner*—Robert G. Nilson
*Attorney, Agent, or Firm*—Robert W. B. Dickerson

[57] ABSTRACT

Mechanism for controlling the flow of fluid between a fluid inlet and a dump outlet, wherein the mechanism includes a dump tube removably engageable with both a valve housing and valve seat, and also a valve member which is removably engageable with the valve seat and slidably guided by the valve housing.

11 Claims, 3 Drawing Sheets

CONTROL MECHANISM FOR WATER BLASTING GUN

BACKGROUND OF THE INVENTION

Control mechanisms have long been used to regulate the flow of fluid under pressure through guns, in the water blasting art. Prime goals are to permit the provision of a high pressure stream of fluid by virtue of a small amount of external force, and to limit the cost of repair and maintenance of the equipment, especially when in the field. Applicant's device is directed toward better accomplishing such goals.

SUMMARY OF THE INVENTION

A first conduit or passageway through a valve housing, or block, provides both an inlet and an outlet for a blasting media, i.e., fluid under pressure. A second parallel passageway communicates between a trigger chamber and a dump inlet. Within said second passageway, the control mechanism comprising valve seating and spring-biased valve elements are positioned. A further, or third passageway communicates between and connects the mentioned first and second and passageways. When water under pressure is provided the first passageway's inlet, and if the valve is open, the fluid will course through the connecting third passageway, into the dump inlet to be exhausted. If the valve is closed, as by the trigger, then such pressurized fluid is prevented from entering the dump and therefore continues through the first passageway, out its outlet, through the gun's nozzle, to its end use. The valve is guided toward engagement with the valve seat by virtue of the valve's stem slidably engaging a bore in said block comprising a part of said second passageway. The valve seat element is releasably linked to the dump tube, or to an adapter thereof, via a male-female fastener arrangement.

DESCRIPTION OF A PREFERRED EMBODIMENT

Figure 1:
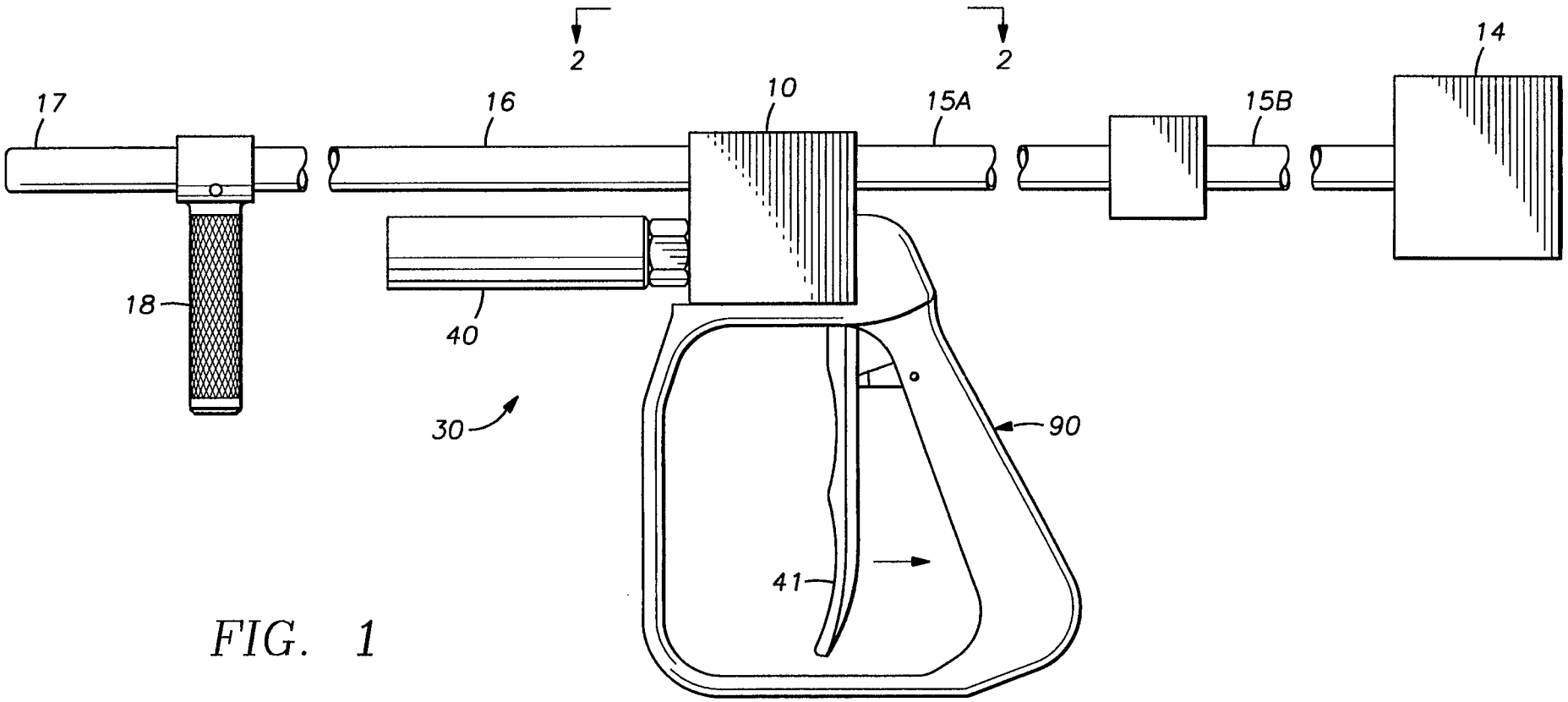
FIG. 1 is a partly schematic, broken side elevation of an assembled water blast gun.

FIG. 1 indicates the general arrangement of parts in a hand-held, water blast gun. The gun housing, or block, 10 is generally rectangular in cross section. It includes a first, or supply conduit 11 therethrough which is internally threaded at opposite ends 12 and 13. Fluid inlet end 13 is connected to a source of water under pressure 14, by tubing and/or hose 15A, 15B.

Opposite supply tube 15A, barrel 16 terminates in a nozzle 17. Slidably mounted along barrel 16 is handgrip 18.

Also extending through block 10, in a direction generally parallel to supply conduit 11, is a valve-containing passageway comprising valve stem guiding bore 21. This bore communicates with trigger chamber 22, which has opposed side walls (not numbered) for receiving pivot pin 92. Bore 21 also communicates with central, annular cavity 23, via shoulder 24. In turn, said annular cavity communicates with counterbore 25, and it with threaded counterbore 26. The last mentioned member 26 exits the block 10, and receives threaded nipple 31 of dump adapter 30.

Dump tube 40 is linked to block 10 by virtue of female threads 41 at one end 42 (the other exhaust end being open). This threaded end receives further male threaded nipple 34 of dump adapter 30. Said adapter is axially bored at 38 and includes stepped, communicating counterbores 39A and 39B. A baffle member 32, containing a plurality of radially spaced apertures 33, depends from hollow nipple 34.

An axially parallel groove 35 extends a short distance along the internal diameter of adapter end 36. Radial groove 37 intersects said axial groove 35.

Figure 2:
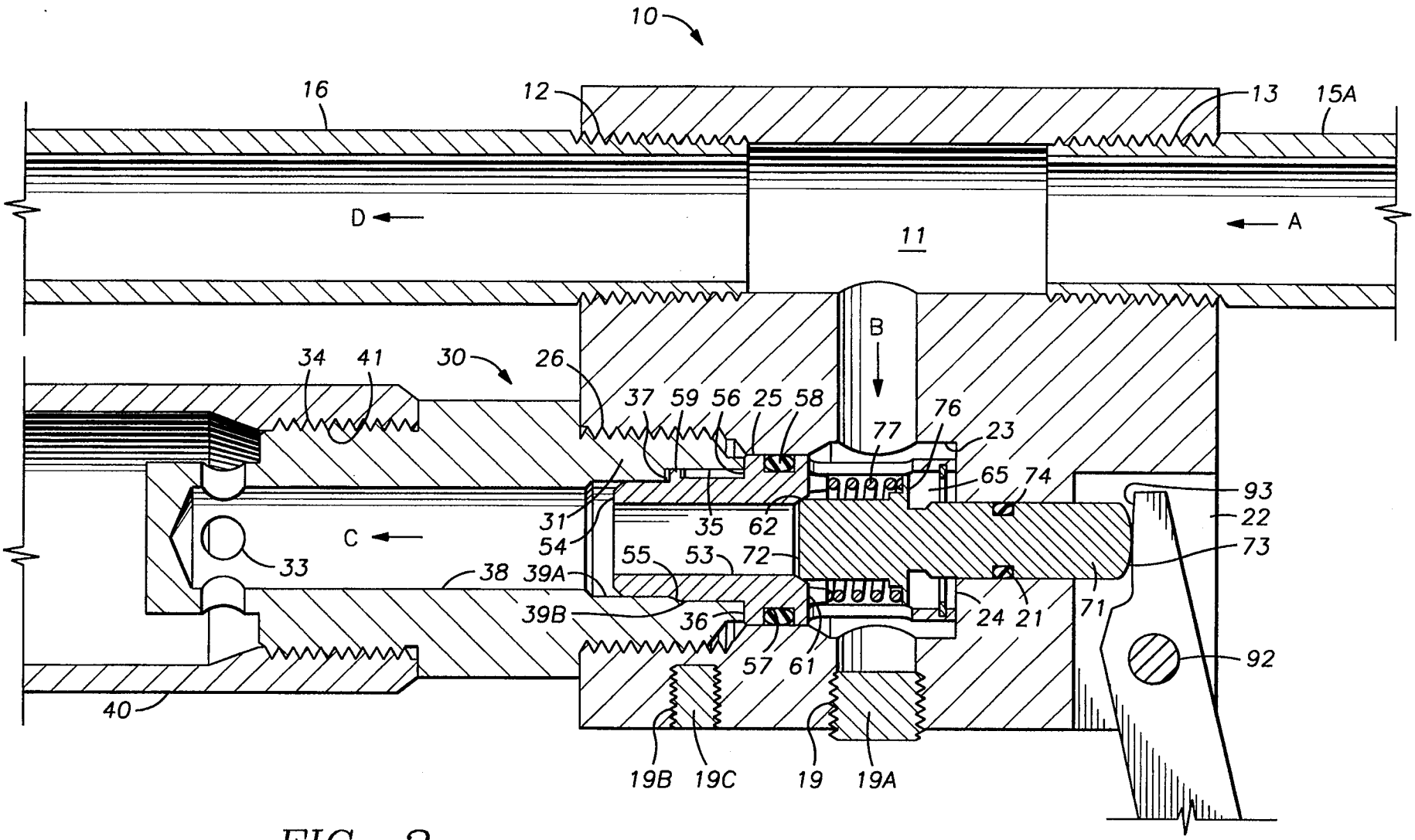
FIG. 2 is a vertical, axial section through the block and control mechanism.
Figure 3:
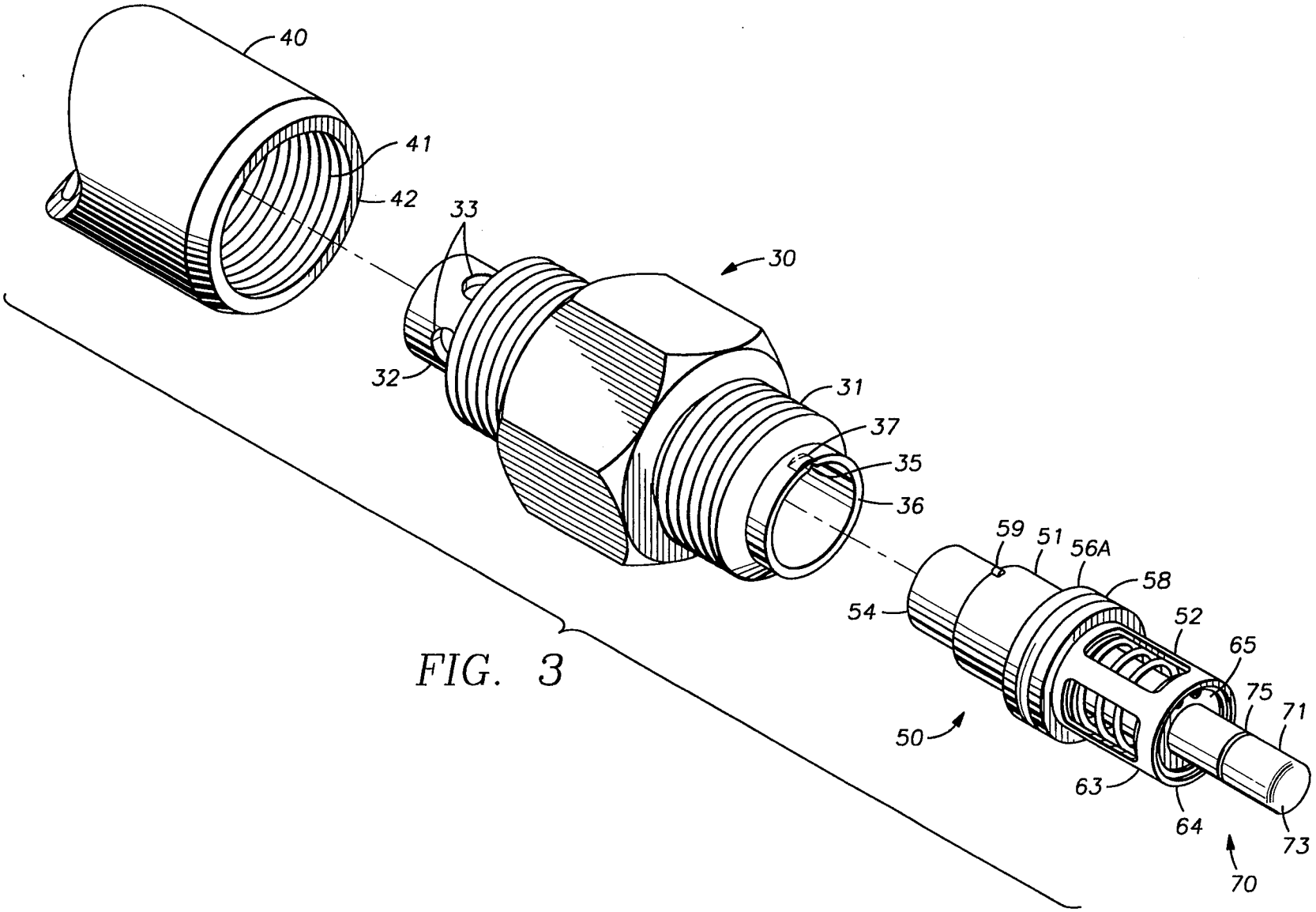
FIG. 3 is an exploded perspective of the valve seat, valve, valve cage and spring, and dump adapter.

Valve cartridge 50 includes seat housing 51 and depending spring cage 52. The seat housing includes axial bore 53 therethrough. Moving to the right in FIG. 2 from end 54, the exterior of seat housing 51 is stair-stepped at 55 and 56. The latter step forms a flange 56A, having an annular groove 57 therein to receive seal 58. Adjacent step 55, lug or lobe 59 depends from the housing. Adjacent housing end 61, the wall of bore 53 is chamfered to form valve seat 62. Depending from flange 56A is spring cage 52. Said cage includes hollow skirt 63, open at each end. Adjacent skirt end 64, the interior wall is annularly grooved to receive retainer clip 65.

Slidably positioned within spring cage 52 is valve 70. This valve includes body or stem 71 which includes its beveled seating surface at one end 72, and an oppositely disposed activating end 73. Intermediate ends 72 and 73, the valve body includes an annular groove 74 to receive o-ring seal 75, and also includes an annular flange 76 which serves both as a seat for spring 77 and as a stop device in conjunction with retainer clip 65.

Valve block 10 includes a threaded bore 19 to removably receive threaded plug 19A. Additional threaded bores or taps 19B receive the threaded shaft 19C of fasteners to secure the block 10 to trigger housing 90. Pivotally positioned within trigger chamber 22, by virtue of pivot pin 92, is trigger mechanism 91. This trigger has valve-engageable end 93.

In operation, like other such devices, a source of pressurized fluid 14 provides such fluid to inlet 13 of gun block 10. If the valve 70 is unseated, the fluid follows the path of arrows A-B-C in FIG. 2. On the other hand, if the user grasps trigger 91, moving it in the direction of the arrow in FIG. 1, the trigger's upper end 93 will pivot about pin 92, engage valve end 73, move it to the left, as in FIG. 2, against the force of spring 77, seating its seating surface 72 against seat 62. This blocks fluid flow through dump tube 40, causing the high pressure fluid to jet through exit barrel 16 and nozzle 17, following the path A-D of FIG. 2.

This inventions uniqueness resides in its valve mechanism and its fastening mechanism between the valve cartridge 50 and the dump adapter 30. The former feature utilizes a housing (block) bore 21 to guide the valve toward its seat. It also uniquely restricts the valve seating portion within the valve cartridge cage by virtue of flange 56A and retainer clip 65.

The latter inventive feature permits the quick securing and/or release of the valve cartridge from the dump adapter by virtue of inserting (removing) lobe 59 into (from) groove 37 via groove 35. Thus, there may be quick removal of the valve and seat cartridge, and the valve, from the block. Since the cartridge and valve are linked to the adapter, and it to the dump tube, when the tube and adapter are rotated counter clockwise, the lobe is secured to one side of the radial groove for removal. During insertion, i.e., rotation clockwise, the lobe is secured to the radial groove's opposite side. Although only a single embodiment has been described, it should be obvious that numerous modifications would be possible by one skilled in the art without departing from the spirit of the invention, the scope of which is limited only by the following claims.

I claim:

1. In a water blasting gun having a block, said block having a high pressure fluid inlet, a high pressure fluid outlet, first passageway means between said high pressure inlet and outlet, a low pressure fluid outlet, second passageway means between said first passageway means and said low pressure outlet, and means for controlling fluid communication between said high pressure fluid inlet and said low pressure fluid outlet, the improvement comprising:

said controlling means including;

valve seat means and valve means positioned in said block, said valve means being biased toward a first position out of engagement with said valve seat means, and valve activating means, engageable with said valve means, for urging said valve means into engagement with said valve seat means, said valve seat means includes a depending cage portion which carries a valve encompassing spring member and slidably receives a valve portion therein; and said block includes bore means for slidably receiving and guiding a stem portion of said valve means.

2. In a water blasting gun having a block, said block having a high pressure fluid inlet, a high pressure fluid outlet, first passageway means between said high pressure inlet and outlet, a low pressure fluid outlet, second passageway means between said first passageway means and said low pressure outlet, and means for controlling fluid communication between said high pressure fluid inlet and said low pressure fluid outlet, the improvement comprising:

said controlling means including:

valve seat means and valve means positioned in said block, said valve means being biased toward a first position out of engagement with said valve seat means, and valve activating means, engageable with said valve means, for urging said valve means into engagement with said valve seat means; and said valve seat means includes a depending cage portion which carries a valve encompassing spring member and slidably receives a valve portion therein.

3. The gun of claim 1 wherein said cage portion includes a valve stop member.

4. The gun of claim 3 and including fluid dump means in communication with said low pressure fluid outlet, said dump means having a tubular portion threadedly engageable with said block, said tubular portion further being releasably engageable with said controlling means.

5. The gun of claim 4 wherein said releasable engaging means includes:

first fastener means carried by said fluid dump means; and second fastener means carried by said controlling means adapted to engage said first fastener means.

6. The gun of claim 5 wherein said first fastener means includes first groove means on said dump means tubular portion and second groove means angularly communicating with said first groove means.

7. The gun of claim 6 wherein said second fastener means comprises lobe means removably engageable with said first fastener means.

8. The gun of claim 7 wherein said first fastener means' second groove means includes opposed ends, and said second fastener means is movably positionable adjacent said opposed ends as a function of the direction of rotation of said dump means.

9. Quick release mechanism for use in a water blast gun, said mechanism comprising:

fluid dump means adapted to removably engage a gun block;

means for controlling fluid passage, through said gun block, said control means including a valve seat housing and valve means;

means for releasably engaging said dump means and said control means; and wherein said fluid dump means' gun engagement means includes threaded tubular means removably engageable with said block, and said control means engaging means comprises a first passageway in a tubular wall of said tubular means and a second passageway angularly communicating with said first passageway.

10. The mechanism of claim 9, wherein said releasable engaging means includes:

first fastener means carried by said fluid dump means; and second fastener means carried by said controlling means adapted to engage said first fastener means.

11. The mechanism of claim 9 wherein said control means includes lug means removably engageable with at least one of said passageways.

* * * * *